US010271135B2

(12) United States Patent
Kvist et al.

(10) Patent No.: US 10,271,135 B2
(45) Date of Patent: Apr. 23, 2019

(54) APPARATUS FOR PROCESSING OF AUDIO SIGNALS BASED ON DEVICE POSITION

(75) Inventors: Preben Kvist, Copenhagen SV (DK); Bjarne Kielsholm-Ribalaygua, Copenhagen NV (DK)

(73) Assignee: Nokia Technologies Oy, Espoo (FI)

( * ) Notice: Subject to any disclaimer, the term of this patent is extended or adjusted under 35 U.S.C. 154(b) by 262 days.

(21) Appl. No.: 13/511,467

(22) PCT Filed: Nov. 24, 2009

(86) PCT No.: PCT/EP2009/065778
§ 371 (c)(1),
(2), (4) Date: Nov. 19, 2012

(87) PCT Pub. No.: WO2011/063830
PCT Pub. Date: Jun. 3, 2011

(65) Prior Publication Data
US 2013/0083944 A1 Apr. 4, 2013

(51) Int. Cl.
*H04R 3/00* (2006.01)
*H04R 1/40* (2006.01)
*G10L 21/0216* (2013.01)

(52) U.S. Cl.
CPC ..... *H04R 1/406* (2013.01); *G10L 21/0216* (2013.01); *H04R 3/005* (2013.01); *G10L 2021/02165* (2013.01); *G10L 2021/02166* (2013.01)

(58) Field of Classification Search
USPC ..... 381/91, 92, 97, 104, 105, 107, 58, 59
See application file for complete search history.

(56) References Cited

U.S. PATENT DOCUMENTS 4,599,561 A 7/1986 Takahashi et al.
5,841,878 A * 11/1998 Arnold ..... G09F 27/00 381/124
6,757,397 B1 * 6/2004 Buecher ..... H04R 1/04 348/14.08
2002/0019678 A1 * 2/2002 Mizokawa ..... G10L 13/033 700/94
2005/0031130 A1 2/2005 Devantier et al.
2005/0185813 A1 8/2005 Sinclair et al. ..... 381/370
(Continued)

FOREIGN PATENT DOCUMENTS

CN 101015001 A 8/2007
CN 101151888 A 3/2008
(Continued)

OTHER PUBLICATIONS

International Search Report and Written Opinion received for corresponding International Patent Application No. PCT/EP2009/065778, dated Aug. 18, 2010, 12 pages.
(Continued)

*Primary Examiner* — George C Monikang
(74) *Attorney, Agent, or Firm* — Harrington & Smith

(57) ABSTRACT

An apparatus comprising at least one processor and at least one memory including computer program code the at least one memory and the computer program code configured to, with the at least one processor, cause the apparatus at least to perform determining a change of position of the apparatus, and processing at least one audio signal dependent on the change in position.

22 Claims, 6 Drawing Sheets

(56) References Cited

U.S. PATENT DOCUMENTS

| | | | | |
|---|---|---|---|---|
| 2006/0009156 | A1* | 1/2006 | Hayes et al. | 455/63.1 |
| 2006/0050892 | A1* | 3/2006 | Song | H04S 7/301 381/59 |
| 2006/0165242 | A1* | 7/2006 | Miki | H04R 3/005 381/59 |
| 2007/0036348 | A1 | 2/2007 | Orr | |
| 2008/0106517 | A1 | 5/2008 | Kerr et al. | |
| 2008/0194290 | A1 | 8/2008 | Lebert et al. | |
| 2008/0226087 | A1* | 9/2008 | Kinghorn | H04S 7/301 381/59 |
| 2008/0260176 | A1 | 10/2008 | Hollemans et al. | |
| 2008/0285772 | A1* | 11/2008 | Haulick | G01S 7/52003 381/92 |
| 2009/0164212 | A1 | 6/2009 | Chan et al. | 704/226 |
| 2009/0192707 | A1* | 7/2009 | Nakatsuka | G01C 21/3629 701/431 |
| 2009/0304205 | A1* | 12/2009 | Hardacker | H03G 3/301 381/104 |

FOREIGN PATENT DOCUMENTS

| | | | |
|---|---|---|---|
| EP | 1306649 | A1 | 5/2003 |
| EP | 1575250 | A1 | 9/2005 |
| EP | 1950940 | A1 | 7/2008 |
| EP | 1950940 | A1 | 7/2008 |
| WO | 2011/063857 | A1 | 6/2011 |

OTHER PUBLICATIONS

Office Action received for corresponding Russian Application No. 2012125899, dated Sep. 30, 2013, 9 pages.

Office action received for corresponding Russian Patent Application No. 2012125899, dated Feb. 19, 2014, 9 pages of office action and 3 pages of office action translation.

* cited by examiner

APPARATUS FOR PROCESSING OF AUDIO SIGNALS BASED ON DEVICE POSITION

RELATED APPLICATION

This application was originally filed as PCT Application No. PCT/EP2009/065778 filed Nov. 24, 2009.

The present invention relates to apparatus for processing of audio signals. The invention further relates to, but is not limited to, apparatus for processing audio and speech signals in audio devices.

In telecommunications apparatus, a microphone or microphone array is typically used to capture the acoustic waves and output them as electronic signals representing audio or speech which then may be processed and transmitted to other devices or stored for later playback. Currently technologies permit the use of more than one microphone within a microphone array to capture the acoustic waves, and the resultant audio signal from each of the microphones may be passed to an audio processor to assist in isolating a wanted acoustic wave. The audio processor may for example determine from the audio signals a common noise or unwanted audio component. This common noise component may then be subtracted from the audio signals to produce an audio signal with ambient noise reduction. This is particularly useful in telecommunications applications where such apparatus may by having at least two microphones, the primary microphone located near to the mouth of the user and a secondary microphone located away from or far from the mouth of the user reduce the effect of environmental noise particularly in hands free operation. The audio signal from the secondary microphone is subtracted from the primary microphone with the assumption that both the primary and secondary microphones receive ambient noise components but only the primary microphone receives the wanted speech acoustic waves from the mouth of the user. This scenario is a simple way of utilizing two microphones but it should be noted that in practice the secondary microphone will not only pick up noise.

With advanced processing capabilities, two or more microphones may be used with adaptive filtering in the form of variable gain and delay factors applied to the audio signals from each of the microphones in an attempt to beamform the microphone array reception pattern. In other words beamforming produces an adjustable audio sensitivity profile.

Although beamforming the received audio signals can assist in improving the signal to noise ratio of the voice signals from the background noise it is highly sensitive to the relative position of the microphone array apparatus and the signal source. Apparatus is therefore designed with a wide and low gain configuration (i.e. as described above and shown in FIG. 3*a* where the user 251 operates a device 10 with a primary microphone beam directed in one direction to capture the voice acoustic waves with a broad low gain profile 201, and a secondary microphone beam in the opposite direction with a second opposite directed broad low gain profile 20 to capture noise. As users often change the position of the phone—especially in long conversations—any attempt to use high gain narrow beam processing may result in the beam not being pointed towards the mouth and producing a lower signal-to-noise ratio than the low gain or standard omni-directional microphone configurations.

This invention proceeds from the consideration that the use of sensors such as motion, orientation, and direction sensors may assist in the control of beamforming/noise reduction and beamforming profile shaping to be applied to the microphones and thus assist the noise cancellation or noise reduction algorithms and improve the signal-to-noise ratio of the captured audio signals.

Embodiments of the present invention aim to address the above problem.

There is provided according to a first aspect of the invention a method comprising: determining a change of position of the apparatus; processing at least one audio signal dependent on the change in position.

The change in position is preferably at least one of: a relative change of position with respect to a further object; and an absolute change of position.

The change in position may comprise at least one of: a change in translational position; and a change in rotational position.

The method may further comprise: detecting a first position of the apparatus; receiving at least one audio signal; and generating for each audio signal at least one signal processing parameter dependent on the first position of the apparatus.

Generating for each audio signal at least one signal processing parameter dependent on the first position of the apparatus may comprise generating at least one of: gain; and delay.

The method may further comprise: generating for each audio signal at least one further signal processing parameter dependent on the detected change of position of the apparatus.

The generating for each audio signal at least one further signal processing parameter may comprise: determining whether the change of position of an apparatus is greater than at least one predefined value; and generating the at least one further signal processing parameter for each audio signal dependent on the at least one predefined value.

Processing the at least one audio signal dependent on the change in position may comprise selecting at least one of the at least one audio signal to output dependent on the change of position.

Processing at least one audio signal dependent on the change in position, may comprise beamforming the at least one audio signal to maintain beam focus on an object.

The at least one audio signal may comprise at least one audio signal captured from at least one microphone.

According to a second aspect of the invention there is provided an apparatus comprising at least one processor and at least one memory including computer program code the at least one memory and the computer program code configured to, with the at least one processor, cause the apparatus at least to perform: determining a change of position of the apparatus; and processing at least one audio signal dependent on the change in position.

The change in position is preferably at least one of: a relative change of position with respect to a further object; and an absolute change of position.

The change in position preferably comprises at least one of: a change in translational position; and a change in rotational position.

The at least one memory and the computer program code is configured to, with the at least one processor, preferably cause the apparatus to further perform: detecting a first position of the apparatus; receiving at least one audio signal; and generating for each audio signal at least one signal processing parameter dependent on the first position of the apparatus.

The at least one signal processing parameter may comprise: a gain coefficient; and a delay coefficient.

The at least one memory and the computer program code is configured to, with the at least one processor, cause the apparatus to preferably further perform: generating for each audio signal at least one further signal processing parameter dependent on the detected change of position of the apparatus.

Generating for each audio signal at least one further signal processing parameter preferably causes the apparatus at least to perform: determining whether the change of position of an apparatus is greater than at least one predefined value; and generating the at least one further signal processing parameter for each audio signal dependent on the at least one predefined value.

Processing the at least one audio signal dependent on the change in position preferably cause the apparatus at least to perform selecting at least one of the at least one audio signal to output dependent on the change of position.

Processing the at least one audio signal dependent on the change in position may cause the apparatus at least to perform beamforming the at least one audio signal to maintain beam focus on an object.

The at least one audio signal may comprise at least one audio signal captured from at least one microphone.

According to a third aspect of the invention there is provided an apparatus comprising a sensor configured to determine a change of position of the apparatus; and a processor configured to process at least one audio signal dependent on the change in position.

The sensor is preferably configured to determine the change in position as at least one of: a relative change of position with respect to a further object; and an absolute change of position.

The sensor is preferably configured to determine a change in position as at least one of: a change in translational position of the apparatus; and a change in rotational position of the apparatus.

The sensor is preferably further configured to determine a first position of the apparatus, and the processor is preferably further configured to: receive at least one audio signal; and generate for each audio signal at least one signal processing parameter dependent on the sensors determined first position of the apparatus.

The at least one signal processing parameter may comprise: a gain coefficient; and a delay coefficient.

At least one of the gain coefficient and the delay coefficient is preferably dependent on the frequency of the at least one audio signal.

The sensor is preferably configured to further determine a second position of the apparatus, and the processor is preferably further configured to generate for each audio signal at least one further signal processing parameter dependent on the detected change of position of the apparatus.

The processor configured to generate for each audio signal at least one further signal processing parameter is preferably configured to: determine whether the change of position of an apparatus is greater than at least one predefined value; and generate the at least one further signal processing parameter for each audio signal dependent on the at least one predefined value.

The processor is preferably configured to select at least one of the at least one audio signal to output dependent on the change of position.

The processor configured to process the at least one audio signal dependent on the change in position is preferably configured to beamform the at least one audio signal to maintain beam focus on an object.

The at least one audio signal may comprise at least one audio signal captured from at least one microphone.

According to a fourth aspect of the invention there is provided an apparatus comprising: sensing means for determining a change of position of the apparatus; and processing means for processing at least one audio signal dependent on the change in position.

According to a fifth aspect of the invention there is provided a computer-readable medium encoded with instructions that, when executed by a computer perform: determining a change of position of the apparatus; and processing at least one audio signal dependent on the change in position.

An electronic device may comprise apparatus as described above.

A chipset may comprise apparatus as described above.

BRIEF DESCRIPTION OF DRAWINGS

For better understanding of the present invention, reference will now be made by way of example to the accompanying drawings in which.

Figure 1:
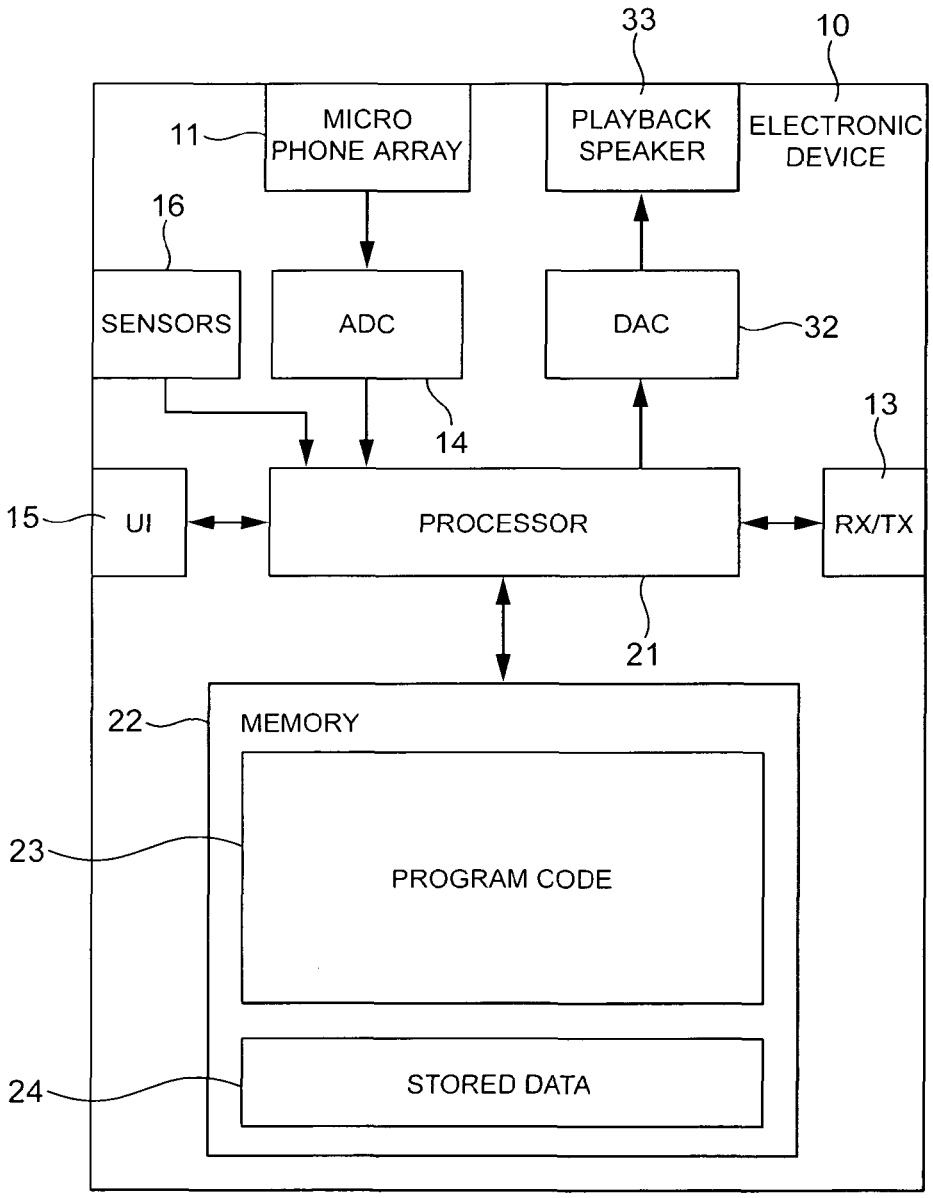
FIG. 1 shows schematically an electronic device employing embodiments of the application.

The following describes apparatus and methods for the provision of enhancing signal to noise performance in microphone arrays (in other words improving noise reduction in microphone arrays). In this regard reference is first made to FIG. 1 which shows a schematic block diagram of an exemplary electronic device 10 or apparatus, which may incorporate enhanced signal to noise performance components and methods.

The electronic device 10 may for example be a mobile terminal or user equipment for a wireless communication system. In other embodiments the electronic device may be any audio player, such as an mp3 player or media player, equipped with suitable microphone array and sensors as described below.

The electronic device 10 in some embodiments comprises a processor 21. The processor 21 may be configured to execute various program codes. The implemented program codes may comprise a signal to noise enhancement code.

The implemented program codes 23 may be stored for example in the memory 22 for retrieval by the processor 21 whenever needed. The memory 22 could further provide a section 24 for storing data, for example data that has been processed in accordance with the embodiments.

The signal to noise enhancement code may in embodiments be implemented at least partially in hardware or firmware.

The processor 21 may in some embodiments be linked via a digital-to-analogue converter (DAC) 32 to a speaker 33.

The digital to analogue converter (DAC) 32 may be any suitable converter.

The speaker 33 may for example be any suitable audio transducer equipment suitable for producing acoustic waves for the user's ears generated from the electronic audio signal output from the DAC 32. The speaker 33 in some embodiments may be a headset or playback speaker and may be connected to the electronic device 10 via a headphone connector. In some embodiments the speaker 33 may comprise the DAC 32. Furthermore in some embodiments the speaker 33 may connect to the electronic device 10 wirelessly 10, for example by using a low power radio frequency connection such as demonstrated by the Bluetooth A2DP profile.

The processor 21 is further linked to a transceiver (TX/RX) 13, to a user interface (UI) 15 and to a memory 22.

The user interface 15 may enable a user to input commands to the electronic device 10, for example via a keypad, and/or to obtain information from the electronic device 10, for example via a display (not shown). It would be understood that the user interface may furthermore in some embodiments be any suitable combination of input and display technology, for example a touch screen display suitable for both receiving inputs from the user and displaying information to the user.

The transceiver 13, may be any suitable communication technology and be configured to enable communication with other electronic devices, for example via a wireless communication network.

The apparatus 10 may in some embodiments further comprise at least two microphones in a microphone array 11 for inputting or capturing acoustic waves and outputting audio or speech signals to be processed according to embodiments of the application. This audio or speech signals may according to some embodiments be transmitted to other electronic devices via the transceiver 13 or may be stored in the data section 24 of the memory 22 for later processing.

A corresponding program code or hardware to control the capture of audio signals using the at least two microphones may be activated to this end by the user via the user interface 15. The apparatus 10 in such embodiments may further comprise an analogue-to-digital converter (ADC) 14 configured to convert the input analogue audio signals from the microphone array 11 into digital audio signals and provide the digital audio signals to the processor 21.

The apparatus 10 may in some embodiments receive the audio signals from a microphone array 11 not implemented physically on the electronic device. For example the speaker 33 apparatus in some embodiments may comprise the microphone array. The speaker 33 apparatus may then transmit the audio signals from the microphone array 11 and thus the apparatus 10 may receive an audio signal bit stream with correspondingly encoded audio data from another electronic device via the transceiver 13.

In some embodiments, the processor 21 may execute the signal to noise enhancement program code stored in the memory 22. The processor 21 in these embodiments may process the received audio signal data, and output the processed audio data.

The received audio data may in some embodiments also be stored, instead of being processed immediately, in the data section 24 of the memory 22, for instance for later processing and presentation or forwarding to still another electronic device.

Furthermore the electronic device may comprise sensors or a sensor bank 16. The sensor bank 16 receives information about the environment in which the electronic device 10 is operating and passes this information to the processor 21 in order to affect the processing of the audio signal and in particular to affect the processor 21 in noise reduction applications. The sensor bank 16 may comprise at least one of the following set of sensors.

The sensor bank 16 may in some embodiments comprise a camera module. The camera module may in some embodiments comprise at least one camera having a lens for focusing an image on to a digital image capture means such as a charged coupled device (CCD). In other embodiments the digital image capture means may be any suitable image capturing device such as complementary metal oxide semiconductor (CMOS) image sensor. The camera module further comprises in some embodiments a flash lamp for illuminating an object before capturing an image of the object. The flash lamp is in such embodiments linked to a camera processor for controlling the operation of the flash lamp. In other embodiments the camera may be configured to perform infra-red and near infra-red sensing for low ambient light sensing. The at least one camera may be also linked to the camera processor for processing signals received from the at least one camera before passing the processed image to the processor. The camera processor may be linked to a local camera memory which may store program codes for the camera processor to execute when capturing an image. Furthermore the local camera memory may be used in some embodiments as a buffer for storing the captured image before and during local processing. In some embodiments the camera processor and the camera memory are implemented within the processor 21 and memory 22 respectively.

Furthermore in some embodiments the camera module may be physically implemented on the playback speaker apparatus.

The camera module 101 may in some embodiments be configured to determine the position of the electronic device 10 with regards to the user by capturing images of the user from the device and determining an approximate position or orientation relative to the user. In some embodiments for example, the camera module 101 may comprise more than one camera capturing images at the same time at slightly different positions or orientations.

The camera module 101 may in some embodiments be further configured to perform facial recognition on the captured images and therefore may estimate the position of the mouth of the detected face. The estimation of the direction or orientation between the electronic device to the mouth of the user, may be applied when the phone is used in a hands-free mode of operation, a hands portable mode of operation, or in a audio-video conference mode of operation where the camera image information may be used both as images to be transmitted but also locate the user speaking to improve the signal to noise ratio for the user speaking.

In some embodiments the sensor bank 16 comprises a position/orientation sensor. The orientation sensor in some embodiments may be implemented by a digital compass or solid state compass configured to determine the electronic devices orientation with respect to the horizontal axis. In some embodiments the position/orientation sensor may be a gravity sensor configured to output the electronic device's orientation with respect to the vertical axis. The gravity sensor for example may be implemented as an array of mercury switches set at various angles to the vertical with the output of the switches indicating the angle of the electronic device with respect to the vertical axis.

In some embodiments the position/orientation sensor comprises a satellite position system such as a global positioning system (GPS) whereby a receiver is able to estimate the position of the user from receiving timing data from orbiting satellites. Furthermore in some embodiments the GPS information may be used to derive orientation and movement data by comparing the estimated position of the receiver at two time instances.

In some embodiments the sensor bank 16 further comprises a motion sensor in the form of a step counter. A step counter may in some embodiments detect the motion of the user as they rhythmically move up and down as they walk. The periodicity of the steps may themselves be used to produce an estimate of the speed of motion of the user in some embodiments. In some embodiments the step counter may be implemented as a gravity sensor. In some further embodiments of the application, the sensor bank 16 may comprises at least one accelerometer configured to determine any change in motion of the apparatus.

The change in motion/position/orientation may be an absolute change where the apparatus changes in motion/position/orientation, or a relative change where the apparatus 10 changes in motion/position/orientation with respect to a localised object, for example relative to the user of the apparatus or more specifically relative to the mouth of the user of the apparatus.

In some other embodiments, the position/orientation sensor 105 may comprise a capacitive sensor capable of determining an approximate distance from the device to the user's head when the user is operating the electronic device. It would be appreciated that a proximity position/orientation sensor may in some other embodiments be implemented using a resistive sensor configuration, a optical sensor, or any other suitable sensor configured to determining the proximity of the user to the apparatus.

It is to be understood again that the structure of the apparatus 10 could be supplemented and varied in many ways.

Figure 2:
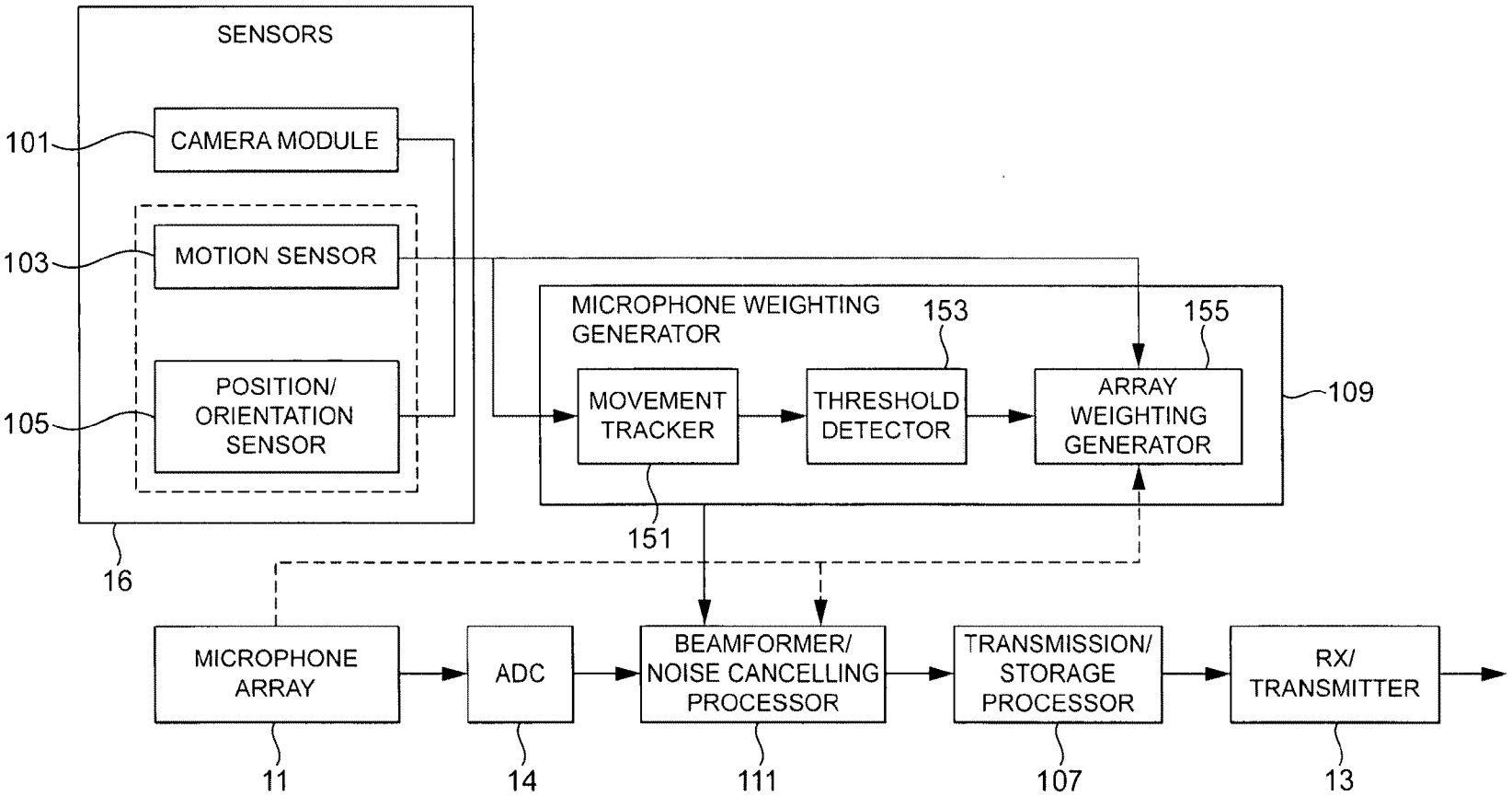
FIG. 2 shows schematically the electronic device shown in FIG. 1 in further detail.
Figure 4A:
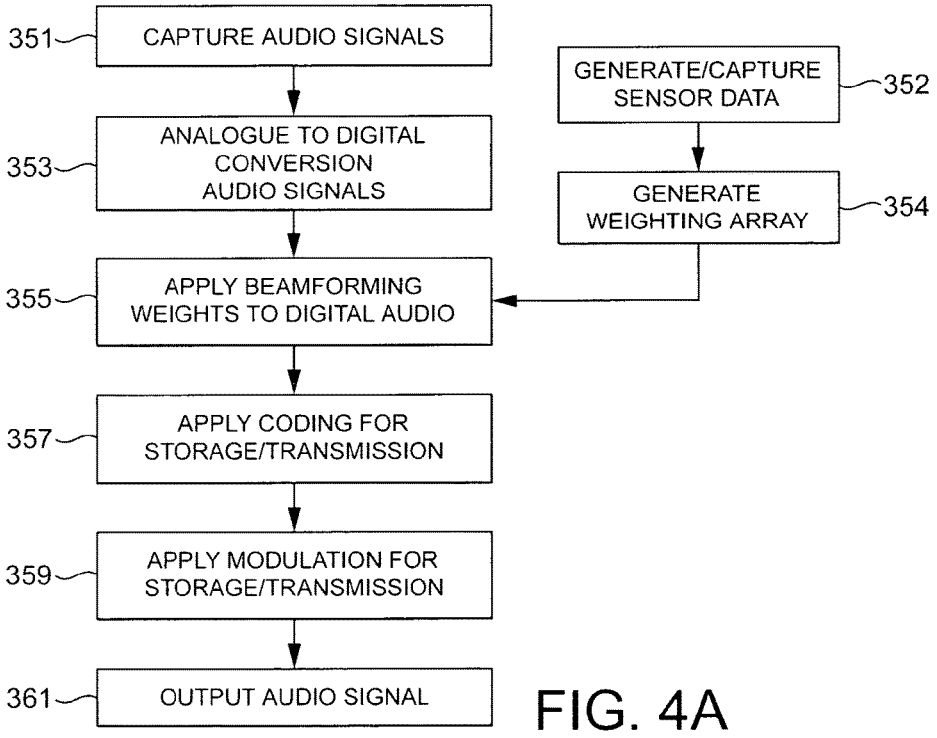
FIGS. 4*a* and 4*b* shows schematically flow charts illustrating the operation of some embodiments of the application.
Figure 4B:
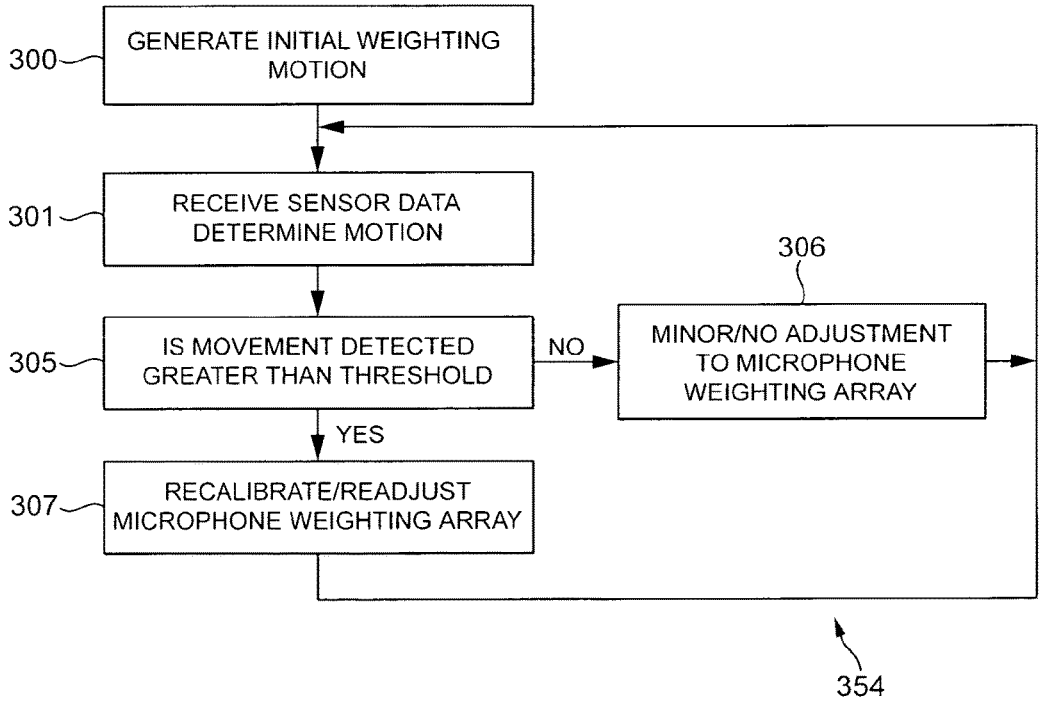

It would be appreciated that the schematic structures described in FIG. 2 and the method steps in FIGS. 4*a* and 4*b* represent only a part of the operation of a complete signal to noise enhancement audio processing chain comprising some embodiments as exemplarily shown implemented in the electronic device shown in FIG. 1.

With respect to FIG. 2 and FIGS. 4*a* and 4*b* some embodiments of the application as implemented and operated are shown in further detail.

The sensor bank 16 as shown in FIG. 2 comprises a camera module 101, and a motion sensor 103 and a position/orientation sensor 105. As described above in some other embodiments there may be more or fewer sensors which go to make up the sensor bank 16.

The sensor bank 16 is configured in some embodiments to output sensor data to the microphone weighting generator 109. The microphone weighting generator 109 may in some embodiments be implemented as programs or part of the processor 21. The microphone weighting generator 109 is in some embodiments further configured to output filtering and gain parameters for controlling the application in an audio signal processor 111. The audio signal processor in some embodiments is a beamformer/noise cancelling processor. The microphone weighting generator 109 is in some embodiments further configured to output weighting parameters which are frequency dependent—in other words the gain and phase parameters are frequency dependent functions in some embodiments of the application.

The microphone array 11 is further configured to output audio signals captured from each of the microphones from the microphone array. The audio signals may then be passed to the analogue-to-digital converter 14. The analogue to digital converter 14 is further connected to the beamformer/noise cancelling processor 111. In some embodiments of the application each of the microphones are connected to a analogue to digital converter and the output from each of the associated analogue to digital converter may be output to the beamformer/noise cancelling processor 111. The beamformer/noise cancelling processor 111 is further configured to be connected to the transmission/storage processor 107. The transmission/storage processor is further configured to be connected to the transmitter of the transceiver 13.

In the following examples the processing of the audio signals for uplink transmission is described. However it would be appreciated in some embodiments, that the beamformer/noise cancelling processor 111 or the transmission/storage processor 107 may output audio data for storage in the memory 22 and in particular to the stored data 24 section in the memory 22.

It would be understood that in some embodiments the beamformer/noise cancelling processor 111 and/or the transmission/storage processor 107 may be implemented as programs or part of the processor 21. In some other embodiments the microphone weighting generator 109, the beamformer/noise cancelling processor 111 and/or the transmission/storage processor 107 may be implemented as hardware.

With respect of FIGS. 4*a* and 4*b*, the operation of some embodiments of the application are shown in further detail.

The microphone array 11 is configured to output audio signals from each of the microphones within the microphone array 11. The microphone array captures the audio input from the environment and generates audio signals which are passed to the analogue-to-digital converter 14. The microphone array 11 may comprise any number or distribution configuration of microphones as discussed previously. For example the microphones within the microphone array may be arranged in a preconfigured arrangement or may if the microphones within the array are variable be able to further signal their relative position configuration in terms of directionality and acoustic profile to each other to the microphone weighting generator 109. This information on the directionality and the acoustic profile of the microphones within the microphone array may in some embodiments also be passed to the beamformer/noise cancelling processor 111.

In some embodiments of the application, the microphone array 11 comprises a number of microphones and a mixer. The mixer in these embodiments is configured to produce a downmix of signals from two or more microphone array microphones to the analogue to digital converter 14 to reduce the number of audio signals or channels from the microphone array to be processed. In such embodiments, the downmix audio signal or signals may be passed to the analogue-to-digital converter 14.

The capturing of the audio signal is shown in FIG. 4*a* by operation 351.

Furthermore, the analogue-to-digital converter (ADC) 14 on receiving the microphone signals may convert the analogue signals to digital audio signals for processing by the beamformer/noise cancelling processor 111. The analogue-to-digital converter 14 may perform any suitable analogue-to-digital conversion operation.

The conversion of the audio signals from the analogue to the digital domain is shown in FIG. 4*a* by operation 353.

Furthermore, in some embodiments the sensors or sensor bank 16 may output sensor data to the microphone weighting generator 109.

In the embodiment shown in FIG. 2, furthermore the sensor bank comprises a camera module 101, a motion sensor 103 and a position/orientation sensor 105. The sensor bank 16 may then be configured to determine the position/orientation of the device and pass this information to the microphone weighting generator 109.

The generation/capturing of the sensor data is shown in FIG. 4*a* by step 352.

The sensor bank 16 outputs the sensor data to the microphone weighting generator 109.

The microphone weighting generator 109 is described in further detail with respect to FIGS. 2 and 4*b*.

The microphone weighting generator 109 may receive at the array weighting generator 155 the sensor data from the sensor bank 16 indicating the position of the device and/or the relative position of the device to the user's mouth. Furthermore the microphone weighting generator 109 may in some embodiments receive the microphone array microphone arrangement and profiles of the microphone.

The microphone weighting generator 109 may in some embodiments use this initial information to generate an initial weighting array dependent on the microphone array configuration information and the initial position/orientation. In some other embodiments the initial weighting array may be generated by the microphone weighting generator 109 dependent on acoustical analysis of the received audio signals.

Any suitable beamforming operation may be used to generate the initial weighting values. In some embodiments the weighting values may be at least one of a gain and a delay value which may be passed to the beamforming/noise cancelling processor 111 to be applied to an audio signal from an associated microphone such that in combination the signal to noise performance of the apparatus is improved. In some embodiments the array weighting generator is configured to be able to output a continuously or near continuous beam array, in other embodiments the array weighting generator 115 is configured to output discrete beamform array weighting functions.

Figure 3A:
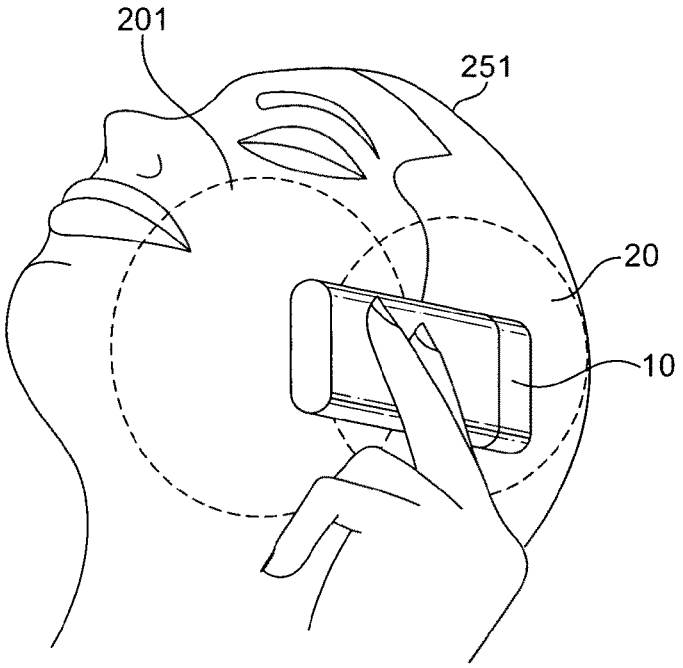
FIGS. 3*a* to 3*e* shows schematically typical handset position/motion changes which may be detected.
Figure 3B:
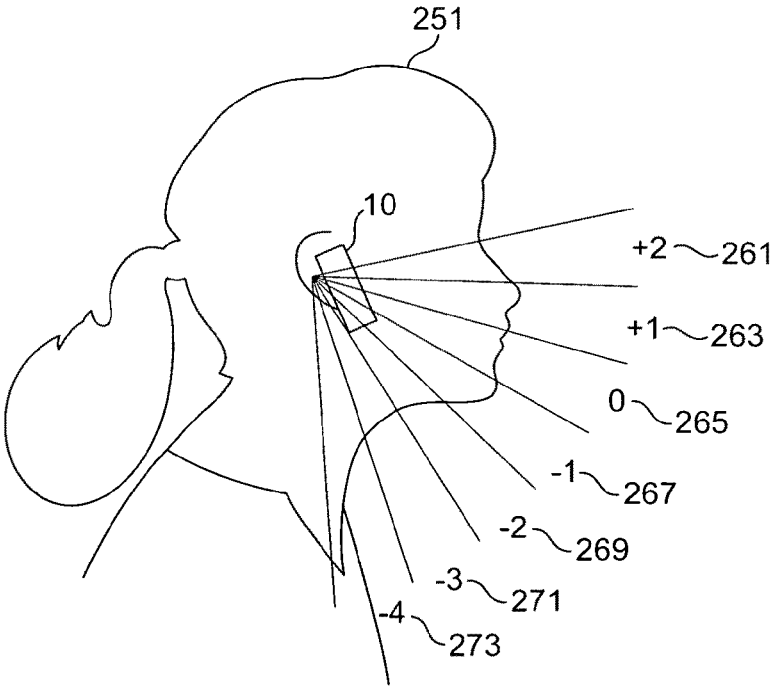

An example of discrete beamform array weighting functions is shown in FIG. 3*b*. The array weighting generator 114 is configured to output one of seven weighting functions to the beamformer 111 which when applied to the microphone array audio signals effectively generates a high gain narrow beam. The array weighting generator 155 having received information on the orientation of the device may generate the array weighting parameters which generate the '0' beam 265 as shown in FIG. 3*b*—which is directed at the mouth of the user. However should the device move or orientate down relative to the user's mouth then the array weighting generator 114 may generate or select the weighting parameters to generate the 'higher' beams the '+1' beam 263, or the '+2' beam 261 directed above the '+1' beam. Similarly should the device move or orientate upwards the 'lower' beams may be selected such as the progressively orientated '−1' beam 267 '−2' beam 269, '−3' beam 271, and '−4' beam 273.

Although in the above example the weighting function controls the positioning or orientation of the beam it would be understood that the array weighting beamformer may output beams with wider or narrower scopes or with higher or lower centre beam gains dependent on the sensor information. Thus for example where the sensor information provided is suspected of being in error the beam can be widened to attempt to cover a wide enough range of direction or where the sensor information is suspected of being accurate a narrower beam may be used.

Furthermore in some embodiments there may be acoustic feedback or tracking control where dependent on sensor information and audio signal information the beamformer attempts to initially 'track' any motion using a wider beam and then 'lock onto' the audio source using a narrower beam.

The generation of the initial weighting array is shown in FIG. 4*b* by step 300.

The microphone weighting generator 109 may then receive further sensor data. Specifically the movement tracker 151 may receive the sensor data and track or compare sensor information.

Figure 3E:
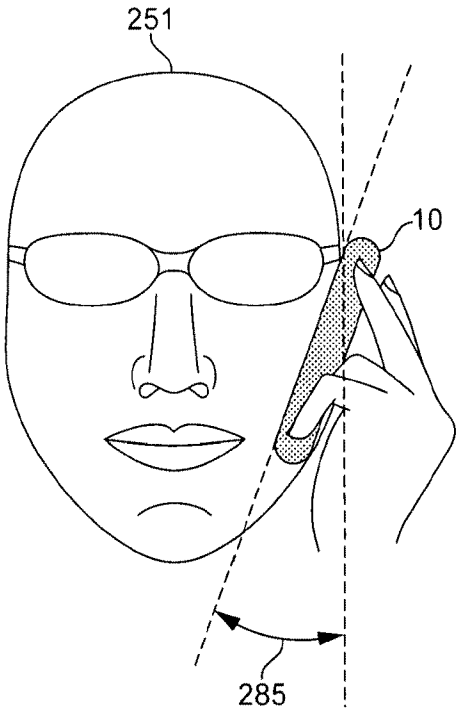
Figure 3D:
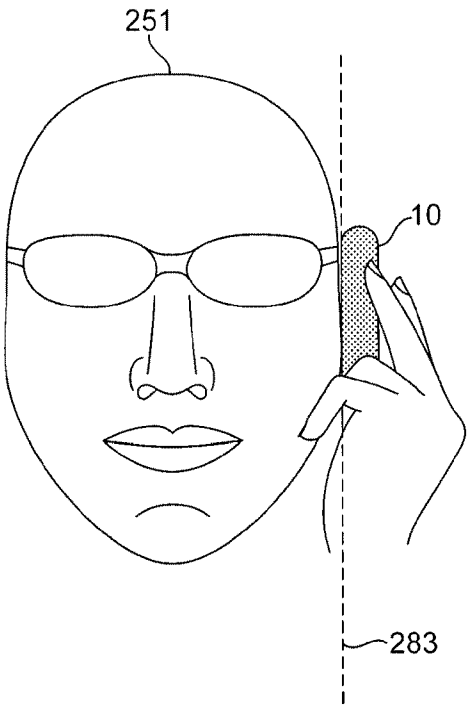
Figure 3C:
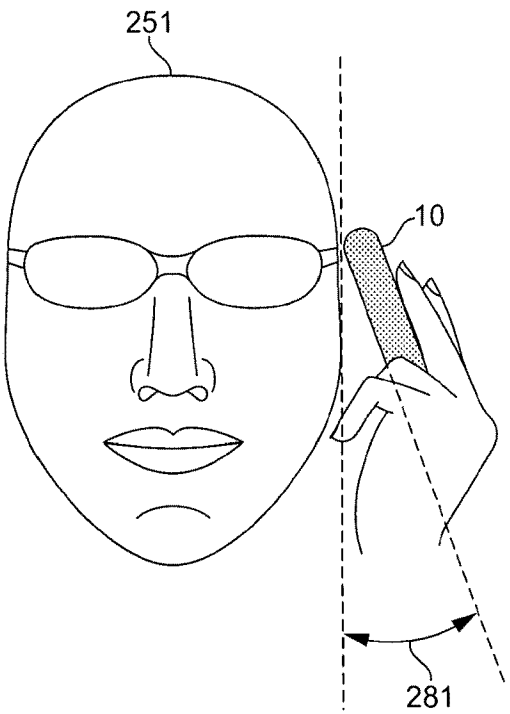

With respect to FIGS. 3*c* to 3*e*, an example of tracking the orientation/position of the device relative to the user is shown.

With regards to FIG. 3*c* the user 251 holds the device 10 with an orientation away from the user at a first angle 281 from the vertical. After a period the electronic device 10 has been moved to a substantially vertical position 283 of the user. Furthermore at a later period the device 10 is shown in FIG. 3*e* as being held with an orientation towards the user at a further angle 285.

The microphone weighting generator 109 movement tracker 151 may furthermore determine the motion vector from the sensor information. The motion vector determined may be passed to the threshold detector 153. In some embodiments, where the sensor bank 16 comprises a movement sensor the threshold detector 153 may receive movement information directly from the sensor bank 16.

The generation of motion information operation is shown in FIG. 4*b* in step 301.

The threshold detector 153 monitors the motion information to determine if the device 10 has been moved. In some embodiments the threshold detector furthermore determines is the device has moved relative to the user. The threshold detector 153 may determine for a specific time period whether the movement detected by the sensor bank is greater than a predetermined threshold.

The operation of checking movement being greater than a predetermined threshold is shown in step 305 in FIG. 4*b*.

If the threshold detector 153 determines that the device has moved (or that the user has moved with respect to the device) greater than the predetermined threshold then the threshold detector 153 generates a re-calibration signal and passes it to the array weighting generator 155.

The array weighting generator 155 may then when receiving the re-calibration signal perform a recalibration/readjustment of the microphone array whereby the array weighting generator in some embodiments uses the previous position estimation, and the movement to produce a new position estimation and from this position estimation generate or select the new beamforming parameters to be passed to the beamformer 111.

Using the example shown in FIG. 3*b* if the sensors detect that the device has moved more than the predefined threshold, which may be the angle of the beam, then the array weighting generator 155 may dependent on the original orientation (and the original selection of '0' beam 265) and the direction of motion (which for example may be a relative downwards motion) then the array weighting generator 155 may generate beamformer parameters for the beamformer 111 to select the '+1' beam 263 or '+2' beam 261. In some other embodiments of the application the weighting generator 109 may generate a signal passed to the audio signal processor 111 to switch off beamforming and instead to select at least one of the microphone audio signal outputs without any processing. In such embodiments there is thus the possibility of generating an audio signal output in such conditions where the user is either out of possible beamforming range and where an omnidirectional microphone output would be more acceptable or where the user or apparatus is moving too quickly to maintain an accurate beamforming 'lock'.

The operation of recalibrating the microphone array weighting parameters is shown in FIG. 4*b* in step 307.

The movement tracker/threshold detector may then further wait for further sensor information.

If the movement detected is less than a predetermined threshold then the threshold detector in some embodiments does nothing. In some other embodiments the threshold detector on detecting some but not motion greater than the predetermined threshold may send a minor readjustment/recalibration signal to the array weighting generator 155. The array weighting generator 109 may perform a either a minor adjustment based on the movement in embodiments where the beamformer 111 may perform small adjustments or no adjustment to the microphone weighting array. The microphone waiting array if readjusted may then be output to the beamformer 111.

The operation of performing a minor or no adjustment to the microphone array weighting parameters is shown in FIG. 4*b* in step 306.

The movement tracker/threshold detector may then further wait for further sensor information.

The operation of generating/monitoring and adjusting the weighting array is shown in FIG. 4*a* by step 354.

The beamformer 111 having received the digital audio signals and also the beamformer weighting array parameters then applies the beamforming weighting array to the audio signal to generate a series of processed audio signals in attempt to improve the signal-to-noise ratio of these signals. Any suitable beamforming algorithm may be used. For example each of the digital audio signals may be input to a filter with an adjustable gain and delay, which is provided from the weighting array parameters.

The output digitally encoded signals may then in some embodiments be passed to the transmission/storage processor 107.

The application of the beamforming weights to the digital audio signals is shown in FIG. 4*a* by step 355.

The transmission/storage processor 107 may then perform further encoding in order reduce the size of the processed audio signals so that the output of the transmission/storage processor 107 is suitable for transmission and/or storage.

This encoding may be any suitable audio signal encoding process, for example the transmission/storage processor 107 may encode the processed audio signals using a ITU G.729 codec which is an audio data compression algorithm optimized for voice encoding that compresses digital voice in packet of 10 m/s duration using a conjugate structure algebraic code excited linear prediction code (CS-ACELP). However, in other embodiments any suitable audio compression procedure may be applied to render the digital audio signal suitable for storage and/or transmission.

The output encoded signals may then be passed to the transceiver 13 (for transmission) or in other embodiments the memory (for storage).

The application of coding for storage/transmission is shown in FIG. 4*a* by step 357.

In some embodiments where the audio signals are transmitted the transceiver 13 may apply modulation processing to the encoded audio signals in order to render them suitable for uplink transmission. Any suitable modulation scheme may be applied for example in some embodiments operating within a UMTS communications network the encoded audio signals may be modulated using a wideband code division multiple access (W-CDMA) modulation scheme.

The application of modulation for transmission is shown in FIG. 4*a* by step 359. Finally the audio signal is output either to the memory or by the transceiver to a further electronic device.

Although the above examples describe embodiments of the invention operating within an electronic device 10 or apparatus, it would be appreciated that the invention as described below may be implemented as part of any audio processor. Thus, for example, embodiments of the invention may be implemented in an audio processor which may implement audio processing over fixed or wired communication paths.

Thus user equipment may comprise an audio processor such as those described in embodiments of the invention above.

It shall be appreciated that the term electronic device and user equipment is intended to cover any suitable type of wireless user equipment, such as mobile telephones, portable data processing devices or portable web browsers.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Therefore in summary there is in at least one embodiment an apparatus comprising: a sensor configured to determine a change of position of the apparatus; and a processor configured to process at least one audio signal dependent on the change in position.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

Thus at least one embodiment comprises a computer-readable medium encoded with instructions that, when executed by a computer perform: determining a change of position of the apparatus; and processing at least one audio signal dependent on the change in position.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circui, or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

determine a change of position of an apparatus, wherein the change in position is determined with at least one non-audio sensor of the apparatus, wherein the at least one non-audio sensor is connected to a housing of the apparatus, and wherein the change in position is determined while the apparatus is in a mode of operation;

processing at least one of at least two microphone audio signals dependent on the change in position of the apparatus during the mode of operation;

wherein the at least two microphone audio signals are provided with at least two microphones of the apparatus configured to form an output microphone audio for the mode of operation, wherein the at least two microphones are positioned inside the apparatus, wherein processing the at least one of the at least two microphone audio signals comprises adjusting an audio profile for the output microphone audio dependent on the change of position, wherein the audio profile comprises a directionality adjustment for the output microphone audio for capturing acoustic waves and eliminating at least in part ambient noise around the apparatus when the directionality adjustment comprises a direction from which the acoustic waves are captured, wherein processing the at least one of the at least two microphone audio signals comprises adjusting the directionality to capture the acoustic waves in the direction or to have no directionality for the output microphone audio dependent on the change in position of the apparatus, and wherein the change in position of the apparatus comprises a relative change of position with respect to an object or an absolute change of position during the mode of operation, and wherein the apparatus is a portable electronic device.

2. The method as claimed in claim 1, wherein the audio profile further comprises at least one adjustable parameter comprising at least one of: sensitivity, or noise cancellation.

3. The method as claimed in claim 1, wherein the change in position comprises at least one of:

a change in translational position; or a change in rotational position.

4. The method as claimed in claim 1, further comprising:

detecting a first position of the apparatus;

receiving at the least one microphone audio signal; and generating for each microphone audio signal at least one signal processing parameter dependent on the first position of the apparatus.

5. The method as claimed in claim 4, wherein generating for each microphone audio signal at least one signal processing parameter dependent on the first position of the apparatus comprises generating at least one of:

gain; or delay.

6. The method as claimed in claim 4, further comprising:

generating for each microphone audio signal at least one further signal processing parameter dependent on the detected change of the first position of the apparatus.

7. The method as claimed in claim 6, wherein the generating for each microphone audio signal at least one further signal processing parameter comprises:

determining whether the change of the first position of the apparatus is greater than at least one predefined value; and generating the at least one further signal processing parameter for each microphone audio signal dependent on the at least one predefined value.

8. The method as claimed in claim 1, wherein processing the at least one microphone audio signal dependent on the change in position comprises selecting at least one of the at least one microphone audio signal to output dependent on the change of position.

9. The method as claimed in claim 1, wherein processing the at least one microphone audio signal dependent on the change in position, comprises beamforming the at least one microphone audio signal to maintain beam focus on the object.

10. The method as claimed in claim 1, wherein the at least one sensor comprises a camera module, and wherein the camera module is configured to determine the change of position relative to a user of the apparatus.

11. The method as claimed in claim 1, wherein the determining of the change of position of the apparatus further comprises determining a change of at least one of position and motion of the apparatus.

12. An apparatus comprising at least one processor and at least one memory including computer program code the at least one memory and the computer program code configured to, with the at least one processor, causes the apparatus at least to:

determine a change of position of the apparatus, wherein the change in position is determined with at least one non-audio sensor of the apparatus, wherein the at least one non-audio sensor is connected to a housing of the apparatus, and wherein the change in position is determined while the apparatus is in a mode of operation; and process at least one of at least two microphone audio signals dependent on the change in position of the apparatus during the mode of operation;

wherein the at least two microphone audio signals are provided with at least two microphones of the apparatus configured to form an output microphone audio for the mode of operation, wherein the at least two microphones are positioned inside the apparatus, wherein processing the at least one of the at least two microphone audio signals comprises adjusting an audio profile for the output microphone audio dependent on the change of position, wherein the audio profile comprises a directionality adjustment for the output microphone audio for capturing acoustic waves and eliminating at least in part ambient noise around the apparatus when the directionality adjustment comprises a direction from which the acoustic waves are captured, wherein processing the at least one of the at least two microphone audio signals comprises adjusting the directionality to capture the acoustic waves in the direction or to have no directionality for the output microphone audio dependent on the change in position of the apparatus, and wherein the change in position of the apparatus comprises a relative change of position with respect to an object or an absolute change of position during the mode of operation, and wherein the apparatus is a portable electronic device.

13. The apparatus as claimed in claim 12, wherein the audio profile further comprises at least one adjustable parameter comprising at least one of: sensitivity, or noise cancellation.

14. The apparatus as claimed in claim 12, wherein the change in position comprises at least one of:

a change in translational position; or a change in rotational position.

15. The apparatus as claimed in claim 12, wherein the at least one memory and the computer program code is configured to, with the at least one processor, causes the apparatus to:

detect a first position of the apparatus;

receive the at least one microphone audio signal; and generate for each microphone audio signal at least one signal processing parameter dependent on the first position of the apparatus.

16. The apparatus as claimed in claim 15, wherein the at least one signal processing parameter comprises:

a gain coefficient; and a delay coefficient.

17. The apparatus as claimed in claim 14, wherein the at least one memory and the computer program code is configured to, with the at least one processor, causes the apparatus to:

generate for each microphone audio signal at least one further signal processing parameter dependent on the detected change of position of the apparatus.

18. The apparatus as claimed in claim 17, wherein causing the apparatus to generate for each microphone audio signal at least one further signal processing parameter causes the apparatus at least to:

determine whether the change of position of the apparatus is greater than at least one predefined value; and generate the at least one further signal processing parameter for each microphone audio signal dependent on the at least one predefined value.

19. The apparatus as claimed in claim 12, wherein causing the apparatus to process the at least one microphone audio signal dependent on the change in position causes the apparatus at least to select at least one of the at least one microphone audio signal to output dependent on the change of position.

20. The apparatus as claimed in claim 12, wherein causing the apparatus to process the at least one microphone audio signal dependent on the change in position causes the apparatus at least to beamform the at least one microphone audio signal to maintain beam focus on the object.

21. The apparatus as claimed in claim 12, wherein the at least one sensor comprises a camera module, and wherein the camera module is configured to determine the change of position relative to a user of the apparatus.

22. The apparatus as claimed in claim 12, wherein determining the change of position of the apparatus further comprises determining a change of at least one of position and motion of the apparatus.

* * * * *